US005598875A

United States Patent [19]

Musha et al.

[11] Patent Number: 5,598,875

[45] Date of Patent: Feb. 4, 1997

[54] REEDING METHOD FOR 1/F FLUCTUATION WARP YARN DISTRIBUTION

[75] Inventors: Toshimitsu Musha, Machida; Yuichi Yanai, Okazaki; Shoji Takagi, Okazaki; Yuki Niwa, Okazaki; Shu Ono, Okazaki, all of Japan

[73] Assignee: Nisshinbo Industries, Inc., Tokyo, Japan

[21] Appl. No.: 437,063

[22] Filed: May 9, 1995

[51] Int. Cl.[6] ..... D03D 49/62

[52] U.S. Cl. ..... 139/192; 364/470.11; 139/1 R; 139/97

[58] Field of Search ..... 364/154, 152, 364/470; D5/47; 139/29, 97, 1 R, 192; 57/206

[56] References Cited

U.S. PATENT DOCUMENTS

| | | |
|---|---|---|
| 1,988,977 | 1/1935 | Andrews . |
| 2,048,001 | 7/1936 | Fish . |
| 2,269,321 | 1/1942 | Scheuer . |
| 2,643,684 | 6/1953 | Taylor . |
| 3,018,801 | 1/1962 | Coon et al. . |
| 3,638,297 | 2/1972 | Ditscherlein . |
| 3,952,386 | 4/1976 | Joly et al. . |
| 4,058,968 | 11/1977 | Benson . |
| 4,059,950 | 11/1977 | Negishi et al. . |
| 4,495,244 | 1/1985 | Phillips . |
| 4,495,560 | 1/1985 | Sugimoto et al. . |
| 5,243,267 | 9/1993 | Ogasawara . |

FOREIGN PATENT DOCUMENTS

| | | | |
|---|---|---|---|
| 549264 | 4/1932 | Denmark . | |
| 0260062 | 3/1988 | European Pat. Off. . | |
| 327950 | 4/1902 | France . | |
| 1490531 | 11/1967 | France . | |
| 464307 | 6/1951 | Italy | 139/192 |
| 0028548 | 2/1985 | Japan | 139/192 |
| 0045647 | 3/1985 | Japan | 139/192 |
| 423652 | 10/1961 | Switzerland . | |
| 1527342 | 12/1989 | U.S.S.R. . | |
| 2022871 | 12/1979 | United Kingdom . | |

OTHER PUBLICATIONS

London, Derwent Publications Ltd., AN 94–045881.

Journal of Japan, Soc. of Precision Machinery vol. 50, No. 6, 1985 'Bioinformation and 1/f Fluctuation' *the whole document*.

Patent Abstracts of Japan, vol. 18 No. 201 (C–1188), 8 Apr. 1994 & JP–A–06 002280 (Toshimitsu Musha) 11 Jan. 1994.

"Biological Signals —Actual Measurement and Analysis—", 1989, Corona Publishing Co.

"Physics of the Living State", Ohmsha, 1994.

"Noise in Physical Systems and 1/f Fluctuations" World Scientific, May 29, 1995 –Jun. 3, 1995.

*Primary Examiner*—Andy Falik

*Attorney, Agent, or Firm*—Nikaido Marmelstein Murray & Oram LLP

[57] ABSTRACT

A weaving method for woven goods in which the warp yarns are disposed among reed dents of uniform spacing in a reed according to a sequence of numerical values having a 1/f fluctuation, thereby imparting a 1/f fluctuation to the arrangement of warp yarns.

3 Claims, 5 Drawing Sheets

REEDING METHOD FOR 1/F FLUCTUATION WARP YARN DISTRIBUTION

BACKGROUND OF THE INVENTION

The present claimed invention relates to weaving woven goods, and more particularly, to a method of weaving goods having a particular feel.

Conventional weaving processes use a reed with constant spacing between the reed wires to weave goods with a constant spacing between warp yarns. Uneven or irregular weaves are woven with randomly-spaced warp yarns, by randomly removing warp yarns passing through the reed dents, and replacing them with yarns having different thicknesses than the yarns remaining in the reed dents.

Conventional weaving machines produce woven goods in which the warp yarns have a uniform spacing or which vary at random. Compared to woven goods which have a natural, "irregular feel" as a result of hand weaving using yarns spun by hand, however, this conventional method of producing randomness results in an artificial texture with very little natural feel. The result is that the product is not particularly comfortable for the wearer.

SUMMARY AND OBJECTS OF THE INVENTION

It is an object of this invention to make woven goods available that provide a natural feeling of comfort to human beings.

It is another object of this invention to provide a weaving method which causes the density of the warp yarns in woven goods to have a correlation, specifically, a 1/f fluctuation, rather than a random variation.

It is yet another objective of this invention to provide a method to produce woven goods with a 1/f fluctuation on an industrial scale.

In the description of this invention, a "1/f fluctuation" is defined as a power spectrum, with a frequency component f, and proportional to $1/f^k$, where k is approximately 1, and is defined as a power spectrum which is similar to the above.

One of the present inventors, Toshimitsu MUSHA, was the first in the world to discover that a 1/f fluctuation would impart a particularly comfortable feel to humans. The results were published in a paper entitled "Seitai Seigyo to 1/f Yuragi" [Biocontrol and 1/f Fluctuation], Journal of Japan Society of Precision Machinery, 1984, Vol. 50, No. 6, and another paper entitled "Seitai Joho to 1/f Yuragi" [Bioinformation and 1/f Fluctuation], Applied Physics, 1985, pp. 429–435, as well as in a recent publication called "Yuragi no Hassou" [The Concept of Fluctuations], published by NHK publishers in 1994. The abstract of these publications read:

> The 1/f fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore a 1/f fluctuation is a fluctuation of the right proportion between these two extremes.

In addition, an excerpt from "Yuragi no Sekai" [The World of Fluctuations], published by Kodansha Publishers, 1980, reads:

> For example, the rhythms exhibited by the human body such as heart beats, hand-clapping to music, impulse-release period of neurons, and alpha-rhythms observed in the brain, are all basically 1/f fluctuations, and it has been shown experimentally that if a body is stimulated by a fluctuation like these biorhythmic 1/f fluctuations, it would feel comfortable. Fluctuations (variations) exist in various forms throughout nature, but the murmur of a brook, a breeze of wind, and other phenomena that impart a comfortable feeling to humans have a 1/f fluctuation, while typhoons and other strong winds that impart uneasiness do not have this 1/f fluctuation.

The present invention includes a weaving method for weaving woven goods, wherein warp yarns are arranged with a 1/f fluctuation through a reed in which the reed dents are of a uniform space, and the warp yarns are separated into two sets to form a shed between the two sets, and weft yarns are passed through the shed, causing the warp yarns and weft yarns to cross over each other, thereby weaving woven goods in which the density of the warp yarns have a 1/f fluctuation.

Additionally, the invention includes a weaving method wherein a prescribed number of warp yarns passes through each adjacent dent in a reed in which the reed dents are of uniform spacing, up to a number of dents corresponding to the value of a sequence of numerical values having a 1/f fluctuation, then leaving the next adjacent dent empty, this procedure being repeated for each value of the sequence. The warp yarns are separated into two sets to form a shed between the two sets, and weft yarns are passed through the shed, causing the warp yarns and weft yarns to cross over each other, thereby weaving woven goods in which the arrangement of warp yarns has a 1/f fluctuation.

The invention further encompasses a weaving method, wherein, groups of warp yarns, in which the number of warp yarns making up a single group correspond to each value in a sequence of numerical values having a 1/f fluctuation, pass through reed dents which are of a uniform spacing. The warp yarns are separated into two sets to form a shed between the two sets, and weft yarns are passed through the shed, causing the warp yarns and weft yarns to cross over each other, thereby weaving woven goods in which the arrangement of warp yarns has a 1/f fluctuation.

As a result of this invention, the arrangement between warp yarns does not change randomly; rather, it has a correlation. Because this correlation has a 1/f fluctuation, it imparts a special feeling of comfort and aesthetic beauty to the wearer. Additionally, woven goods with a hand-woven, natural, irregular feel can be manufactured at low cost on an industrial scale. Incorporating a melody or tone having a 1/f fluctuation into woven goods can evoke a feeling of comfort in the wearer.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT OF THE INVENTION

A working example of this invention will be explained below using the drawings.

1. Overview of a Weaving Machine

Figure 1:
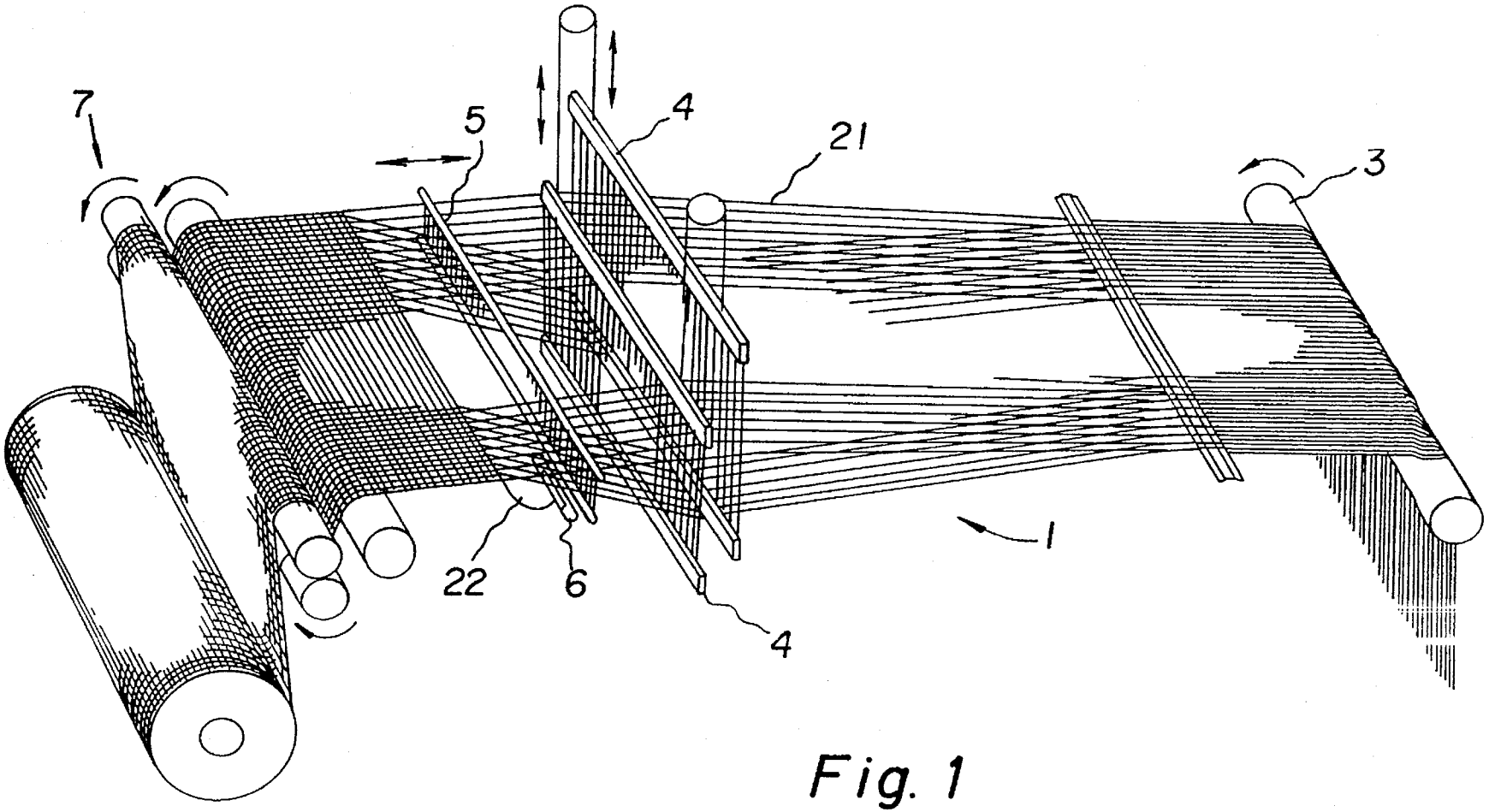
FIG. 1 shows an overview diagram of the principal components of a weaving machine useable in the present invention.

Weaving machine 1 weaves spun yarn into woven goods 2 through the primary movements of opening the shed, inserting the weft yarn, and beating the weft, and the secondary movements of letting off warp yarns 21 and taking up the woven goods 2. The general construction of which is shown in FIG. 1.

The opening of the shed divides all the warp yarns 21 into two sets, forming an opening through which the weft yarn 22 passes, which causes warp yarns 21 and weft yarn 22 to cross over each other. For this purpose, warp yarns 21 are drawn in through two sets of heddles 4 in a prescribed order. The up and down action of these heddles 4 separates the warp yarns 21 vertically. The weft insertion movement is accomplished by passing shuttle 6, into which a wooden tube is inserted and on which weft yarn 22 is wound, through the inside of the shed formed by the warp yarns, thereby beating the weft yarn across the warp yarns. In addition to a shuttle, other methods of weft insertion may be used, including air, water, rapiers, grippers, etc.

The weft beating motion causes warp yarn 21 and weft yarn 22 to cross each other by using reed 5 to apply pressure to weft yarn 22, which has passed through the inside of the shed formed by the warp yarns, forcing the weft yarns into a prescribed position. Let-off device 3 for warp yarns 21 gradually feeds warp yarn 21 and take-up device 7 rolls up the woven goods 2. The take-up speed for the woven goods 2 can be set at a constant rate or can also be controlled so that the speed varies.

2. Reed

Figure 2:
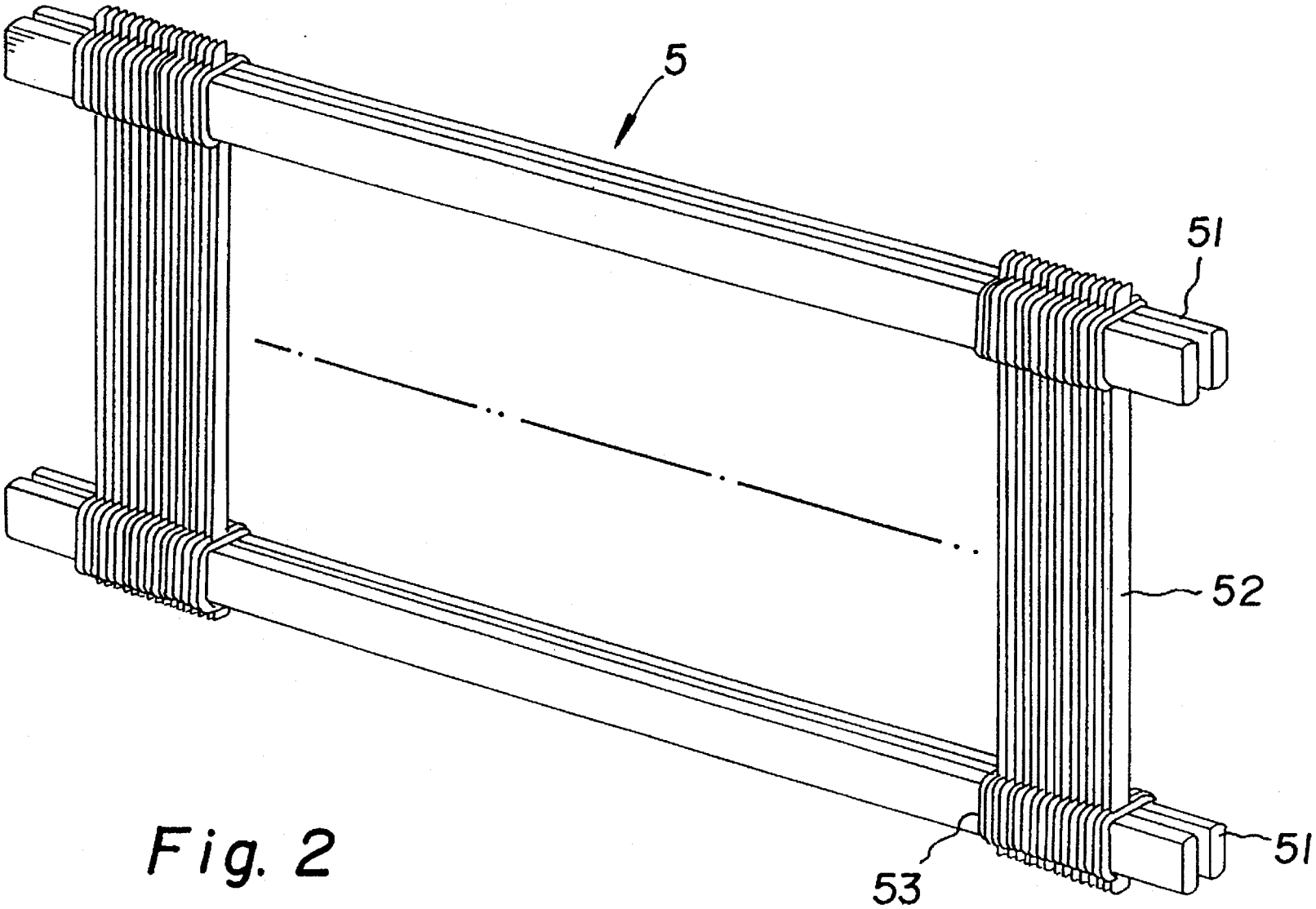
FIG. 2 illustrates a reed for use in the present invention.

Reed 5 determines the spacing between warp yarns 21, and as shown in FIG. 2, is constructed so that reed wires or dents 52 are arranged between two bars 51. For example, reed wires 52 can be fabricated from steel, and have a width of 2.8 mm and a thickness of 0.2 mm. The spacing of the reed dents is fixed at a reed density of 77.7 dents/2 inches, or 26.8 dents/inch. A fixed spacing can also be obtained by using yarn of a uniform thickness 53.

3. 1/f Fluctuation Numerical Sequence

The 1/f fluctuation numerical sequence is determined from $y_1, y_2, y_3, \ldots$ formed by multiplying n coefficients, $a_1, a_2, a_3, \ldots, a_n$, on numbers, $x_1, x_2, x_3, \ldots$. Generally, $y_j$ can be expressed by Equation 1 shown below. Here, the sequence of numerical values forming $y_1, y_2, y_3, \ldots$ has a 1/f spectrum. (For further details, refer to Seitai Shingou [Biological Signaling], Chapter 10, "Seitai Rizumu to Yuragi" [Biological Rhythms and Fluctuations], published by Corona Publishers, Ltd.)

$$y_j = x_j + \left(\frac{1}{2}\right) x_{j-1} + \left(\frac{1*3}{2^2*2!}\right) x_{j-2} + \left(\frac{1*3*5}{2^3*3!}\right) x_{j-3} + \ldots \cdots \left(\frac{1*3*5*\ldots*(2n-1)}{2^{n-1}*(n-1)!}\right) x_{j-n+1} \quad (1)$$

Figure 3:
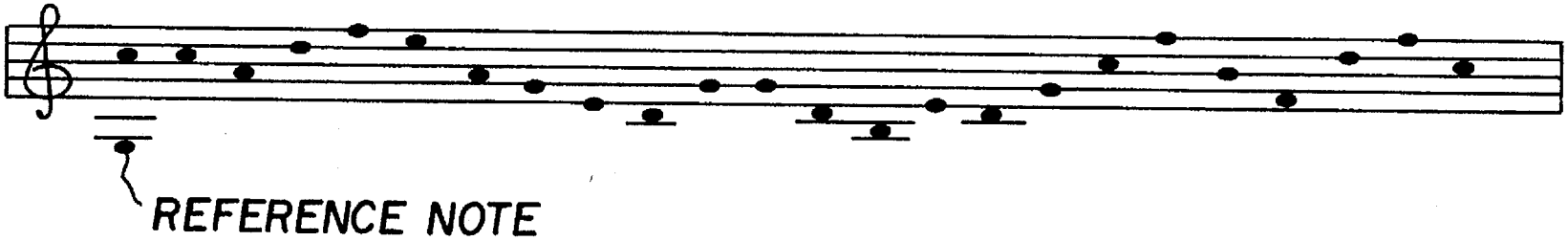
FIG. 3 illustrates a portion of a melody with a 1/f fluctuation.

The sequence of numerical values having a 1/f fluctuation is obtained in two steps. In step 1, a computer, for example, generates a sequence of random numbers, x. In step 2, a certain number, n, of coefficients, a, stored in a storage device, are successively multiplied on the random numbers, and then a sequence of numerical values, y, is obtained by a linear transformation. This numerical sequence, y, has a 1/f spectrum, and can be used as a sequence of numerical values having a 1/f fluctuation. A melody having a 1/f fluctuation can be generated from this sequence of numerical values, y, having a 1/f sequence. First, the scale and the range (lowest frequency fL and highest frequency fU) are determined. Next, a 1/f sequence, y, is derived, and a linear transformation is performed so that the upper and lower limits become the lowest frequency fL and highest frequency fU, respectively. The values of the sequence, y, so derived are regarded as acoustic oscillation frequencies, and are substituted for the oscillation frequencies of the notes they most closely approximate on the scale. In other words, they are arranged, for example, as quarter notes, between or on the lines of a staff on music paper. FIG. 3 shows a portion of a melody derived using this method. The sequence of numerical values 1 given below is derived by assigning numerical values corresponding to the notes in the melody shown in FIG. 3, giving a value of 1 to the reference note. Sequence of numerical values 2 is derived by a proportional calculation based on sequence 1 set forth below.

Sequence of numerical values 1=. . . 10, 10, 8, 11, 13, 12, 8, 7, 5, 4, 7, 7, 4, 2, 5, 4, 7, 10, 13, 9, 6, 11, 13, 10, . . . .

Sequence of numerical values 2=. . . 20, 20, 16, 22, 26, 24, 16, 14, 10, 8, 14, 14, 8, 4, 10, 8, 14, 20, 26, 18, 12, 22, 26, 20, . . . .

4. Woven Goods Example I

Figure 4A:
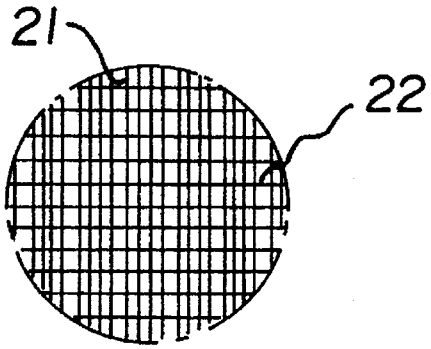
FIG. 4 is an enlarged diagram of woven goods in which the density of the warp yarn has a 1/f fluctuation.
Figure 4:
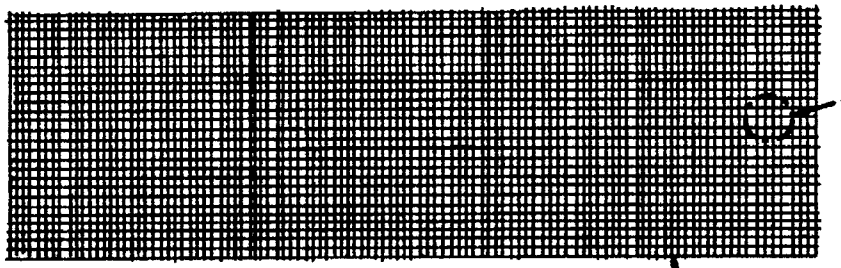
Figure 5:
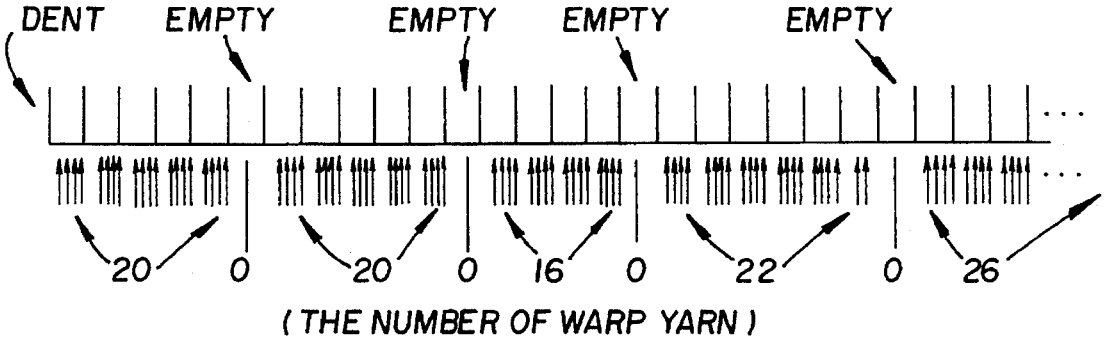
FIG. 5 is a schematic of uniformly spaced reed dents in which an immediate adjacent dent is left empty corresponding to a value of the sequence of numerical values having a 1/f fluctuation.
Figure 6:
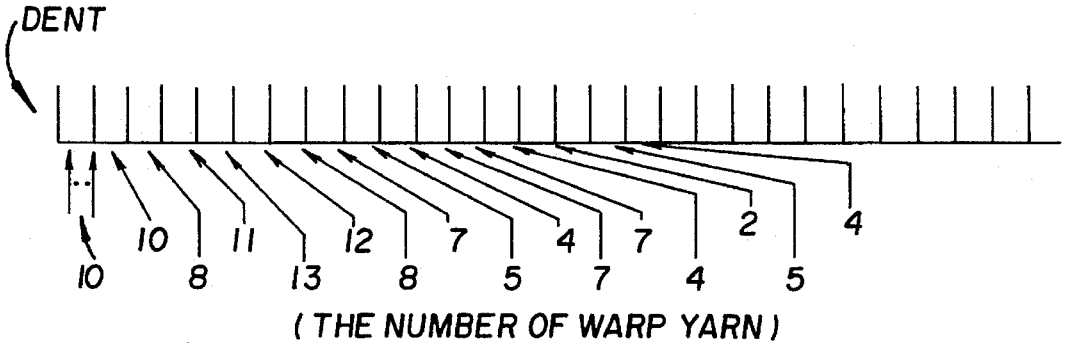
FIG. 6 is a schematic of uniformly spaced reed dents in which the groups of warp yarns corresponding to a 1/f fluctuation are passed through the reed dents.

One example of woven goods 2 in which the arrangement of warp yarns 21 has a 1/f fluctuation (woven goods Example I) can be obtained by a plain weave with a weft yarn density of 75 threads/inch using a cotton yarn in the 50/1 class for both warp yarns 21 and weft yarns 22 and with a reed density of 77.7 dents/2 inches. Using, for example, the sequence of numerical values 2 having a 1/f fluctuation, an arrangement of warp yarns 21 is created using the sequence of numerical values 2 by setting the number of warp yarns passing through a dent at four, and if there is a remainder (upon dividing the numerical sequence value by 4), then two warp yarns are passed through that dent. In other words, 20 warp yarns are disposed among 5 dents (an arrangement of 4 yarns per dent), then one dent is left empty (no warp yarn 21 passes through it), and the next 20 yarns are disposed among 5 dents, then one dent is left empty, and the next 16 yarns are disposed among 4 dents, then one dent is left empty, and the next 22 yarns are disposed among 5 dents of 4 yarns each and one dent of 2 yarns, then one dent is left empty, and so on, disposing warp yarns 21 in this manner among adjacent dents in a prescribed sequence according to the sequence of numerical values 2. A portion of a woven goods 2 obtained in this way is shown in FIG. 4, in which the background color of woven goods 2 is set to black; thus, white indicates yarns and black indicates spaces between yarns.

5. Woven Goods Example II

Another example of woven goods 2 in which the arrangement of warp yarns 21 has a 1/f fluctuation (woven goods Example II) can be obtained by a plain weave with a weft yarn density of 61 threads/inch using a cotton yarn in the 5011 class for both warp yarns 21 and weft yarns 22 and with a reed density of 26.8 dents/2 inches. Using, for example, the sequence of numerical values 1 having a 1/f fluctuation, an arrangement of warp yarns 21 is created in which the number of warp yarns passing through a dent is set to correspond to each numerical value in the sequence of numerical values. In other words, 10 warp yarns are disposed in a single dent, the next 10 yarns are also disposed in a single dent, and the next 8 yarns are disposed in a single dent, and so on, disposing warp yarns 21 in this manner among adjacent dents in a prescribed sequence according to sequence of numerical values 1.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A weaving method for weaving woven goods, comprising;

passing warp yarns through a reed having uniformity spaced reed dents so that the spacings between the yarns are arranged in a pattern having a 1/f fluctuation throughout the reed width;

separating said warp yarns into two sets to form a shed between said two set; and passing weft yarns through said shed, causing said warp yarns and weft yarns to cross over each other, thereby weaving woven goods in which the arrangement of warp yarns has the 1/f fluctuation.

2. A weaving method for weaving woven goods, comprising:

first, passing a prescribed number of warp yarns through each adjacent dent in a reed in which the reed dents are of uniform spacing, up to a number of dents corresponding to a value of a sequence of numerical values having a 1/f fluctuation;

then secondly, leaving empty the dent immediately adjacent to said number of dents corresponding to said value of said sequence;

repeating said first and second steps for each value of said sequence;

separating said warp yarns into two sets to form a shed between said two sets; and passing weft yarns through said shed, causing said warp yarns and weft yarns to cross over each other, thereby weaving woven goods in which an arrangement of warp yarns has the 1/f fluctuation.

3. A weaving method of weaving woven goods, comprising:

passing groups of warp yarns in which the number of warp yarns making up a single group correspond to each value in a sequence of numerical values having a 1/f fluctuation through a reed in which reed dents are of a uniform spacing;

separating said warp yarns into two sets to form a shed between said two sets; and passing weft yarns through said shed, causing said warp yarns and weft yarns to cross over each other, thereby weaving woven goods in which an arrangement of warp yarns has the 1/f fluctuation.

* * * * *

UNITED STATES PATENT AND TRADEMARK OFFICE

CERTIFICATE OF CORRECTION

PATENT NO. : 5,598,875

DATED : February 4, 1997

INVENTOR(S) : Musha et al.

It is certified that error appears in the above-indentified patent and that said Letters Patent is hereby corrected as shown below:

On the title page;

Item [30], insert therefor -- Foreign Application Priority Data No. 6-126910, Country Japan; Date May 17, 1994 --

Signed and Sealed this

Twenty-eighth Day of July, 1998

Bruce Lehman

*Attest:*

BRUCE LEHMAN

*Attesting Officer*

*Commissioner of Patents and Trademarks*